US005870839A

United States Patent [19]

Wissmiller

[11] Patent Number: 5,870,839

[45] **Date of Patent: *Feb. 16, 1999**

[54] HITCH FOR A MOLDBOARD SNOW PLOW

[76] Inventor: Joseph E. Wissmiller, P.O. Box 87, 102 S. Jeffrey, Cooksville, Ill. 61730

[ * ] Notice: The term of this patent shall not extend beyond the expiration date of Pat. No. 5,706,591.

[21] Appl. No.: 934,264

[22] Filed: Sep. 19, 1997

Related U.S. Application Data

[63] Continuation of Ser. No. 614,898, Mar. 13, 1996, Pat. No. 5,706,591.

[51] Int. Cl.[6] ..... E01H 5/04

[52] U.S. Cl. ..... 37/231; 37/234; 172/272

[58] Field of Search ..... 37/231, 232, 234, 37/235, 236; 172/127, 259, 260.5, 413, 459, 772, 666, 705, 815, 272

[56] References Cited

U.S. PATENT DOCUMENTS

| | | | |
|---|---|---|---|
| 3,233,350 | 2/1966 | Malzahn et al. . | |
| 4,328,628 | 5/1982 | Thomas . | |
| 4,565,018 | 1/1986 | Oya . | |
| 4,615,130 | 10/1986 | Racicot . | |
| 5,082,065 | 1/1992 | Fletcher . | |
| 5,136,795 | 8/1992 | Rosenberg . | |
| 5,195,261 | 3/1993 | Vachon . | |
| 5,706,591 | 1/1998 | Wissmiller | 37/231 |

OTHER PUBLICATIONS

Lawton's Equipment, Inc. brochure on The Lawton Rote Series Reversible Trip Edge Moldboard Snow Plow, 1993.

Valk Manufacturing Company's brochure entitled"Valk Snowplows" (undated).

The Gledhill Road Machinery Co. brochure entitled "Gledhill Snow Plows Straight Moldboard Models," Bulletin S–SB 9009 (undated).

*Primary Examiner*—Thomas B. Will
*Assistant Examiner*—Robert Pezzuto
*Attorney, Agent, or Firm*—Banner & Witcoff Ltd.

[57] ABSTRACT

An improved adjustable mounting bracket for a moldboard snow plow includes a horizontal box beam, cross member which is attached by lugs to the back side of the plow and a third hitch connection which is attached to a bracket mounted on the box beam member. A support arm for a yoke fits over the mid-point of the box beam and is pivotally connected by a pin. The support arm is attached to a first frame member which overlays a second frame member mounted on the truck. The frame members are linked to one another and the first frame members may be moved vertically relative the second by an hydraulic cylinder. The construction is especially compact and lightweight.

7 Claims, 2 Drawing Sheets

HITCH FOR A MOLDBOARD SNOW PLOW

This application is a continuation application under 37 C.F.R. 1.60, of prior application of Joseph E. Wissmiller U.S. Ser. No. 08/614,898, filed on Mar. 13, 1996 for HITCH FOR A MOLDBOARD SNOW PLOW, now U.S. Pat. No. 5,706,591.

BACKGROUND OF THE INVENTION

Moldboard snow plows are typically mounted to the front end of a truck or vehicle by means of a bracket or hitch mechanism which permits easy removal of the plow for repair or replacement or storage. The hitch mechanism for a moldboard plow often includes hydraulics which effect adjustment of the angle of the plow by pivotal movement about a vertical pivot axis so that the plow may be centered or tilted to the left or right of the direction of vehicle travel. Typically, in plowing operations, especially in the United States where driving occurs on the right-hand side of road, the plow will be canted or tilted so that the right-hand side of a straight moldboard plow trails the left-hand side. In this manner, snow is pushed or ejected to the right as the vehicle moves forward advancing the plow through snow. Of course, in certain circumstances the angle or inclination of the plow about its vertical axis must be adjusted. Additionally, the plow may need to be raised or lowered. For example, when plowing on an upward incline it may be necessary to raise the plow and tilt the plow so that the plow will move appropriately up the incline. Similarly, when plowing downhill, it may be desirable to lower the plow and perhaps tilt the plow downwardly.

There are various straight moldboard snow plows and associated mounting brackets available in the marketplace. For example, the Gledhill Road Machinery Company of Galion, Ohio manufactures various moldboard plow models. Valk Manufacturing Company of Carlisle, Pa. also makes similar snow plow constructions. Lawtons' Equipment, Inc., of Paris, Ill. also makes similar snow plow constructions.

The support bracket available from these companies for holding a plow on the front of a vehicle also has a variety of constructions. Typically the support bracket includes a forwardly extending support mounted on a frame. The support may be pivotally attached to the frame. The frame may include an actuator and guide member which imparts angular movement to the support bracket on the frame about a vertical pivot. The construction is typically made from steel angle iron.

While the known prior art moldboard snow plows and associated mounting brackets work well, a need persists for a snow plow brackets support construction which is more compact and is a lighter weight mechanism for attaching a moldboard plow to a vehicle. Additionally, a need for improved maneuverability persists with respect to such plows and associated mounting brackets. Also, when using hydraulic cylinders to effect a change in the angle of such a plow mounted on a bracket, two cylinders have been required typically to effect operation. A need, therefore, to provide a mounting bracket mechanism for moldboard snow plows which utilizes a single cylinder for plow angle control persists inasmuch as a single cylinder will be less costly and will operate more quickly and effectively because less hydraulic pumping will be required in order to effect operation of a single cylinder.

The effect of the weight of the plow and support bracket on the front end of a plow vehicle tends to cause the vehicle to tip forward. For this reason, it is often necessary to load or weight the rear end of a vehicle. By providing a plow construction which has a lighter weight and a bracket attachment mechanism which has a lighter weight and which permits positioning of the plow closer to the vehicle, the center of gravity of the snow plow and the bracket associated therewith may be maintained closer to the center of gravity of the vehicle. This is a desirable objective.

Thus, there are many reasons to provide an improved plow construction and more particularly a mold board plow construction and bracket for attachment thereof to a vehicle.

SUMMARY OF THE INVENTION

Briefly the present invention comprises an adjustable mounting bracket for support of a moldboard snow plow. The mounting bracket is fabricated from steel, box beams in the preferred embodiment. The mounting bracket permits pivotal movement of the snow plow about a vertical axis in the range of approximately 70° from right to left or 35° from the center to each side.

The improved bracket of the invention includes a box beam, forward support cross member for direct attachment to and support of the plow. The box beam forward support cross member is positioned between two spaced plates which define a yoke. The cross member is attached to the plates by a vertical pin that permits pivotal movement of the cross member and attached plow. The spaced plates are affixed to the end of a support member that is attached to a vertical support frame which, in turn, is attached by pivoting links to a vertical frame mounted on the vehicle or truck. A single hydraulic cylinder extends between the support member and the forward support cross member. The cylinder is operable to pivot the cross member about the pivot pin. Typically and preferably, the cylinder is positioned on the right hand side of the vehicle inasmuch perhaps 95 percent of the operation of the plow requires tilting of the plow to effect a right hand throw of snow being plowed. Thus, the cylinder is typically maintained in its retracted position and, in fact, can be utilized in combination with a stop to maintain the angle of the plow in the right hand direction. The stop prevents binding of the cylinder.

The plow may further be adjusted vertically upwardly and downwardly by means of operation of a second cylinder which pivots main support frame with respect to the frame mounted on the truck.

The support member also includes a bracket member which connects the support member to the main support frame. This bracket member includes a lug to which a link is attached that connects to the plow. In this manner, the plow is supported by a three point hitch.

Thus, it is an object of the invention to provide a less costly moldboard snow plow bracket assembly or mounting bracket for attaching a moldboard snow plow to a vehicle.

It is a further object of the invention to provide a mounting bracket for a snow plow which is fabricated principally from box beams so as to strengthen the construction while at the same time reducing the weight of the construction relative to prior art constructions.

Yet a further object of the invention is to provide an improved mounting bracket for support of a snow plow on a vehicle wherein the bracket is constructed in a manner which eliminates or reduces significantly the spacing between the front end of the vehicle and moldboard plow.

Yet another object of the invention is to provide a mounting bracket for a moldboard snow plow which utilizes a single control cylinder for movement of the plow about a vertical axis.

These and other objects, advantages and features of the invention will be set forth in the detailed description that follows.

BRIEF DESCRIPTION OF THE DRAWINGS

In the detailed description of the drawings the following reference will be made to the drawing comprised of the following FIGURES.

DESCRIPTION OF THE PREFERRED EMBODIMENT

Figure 1:
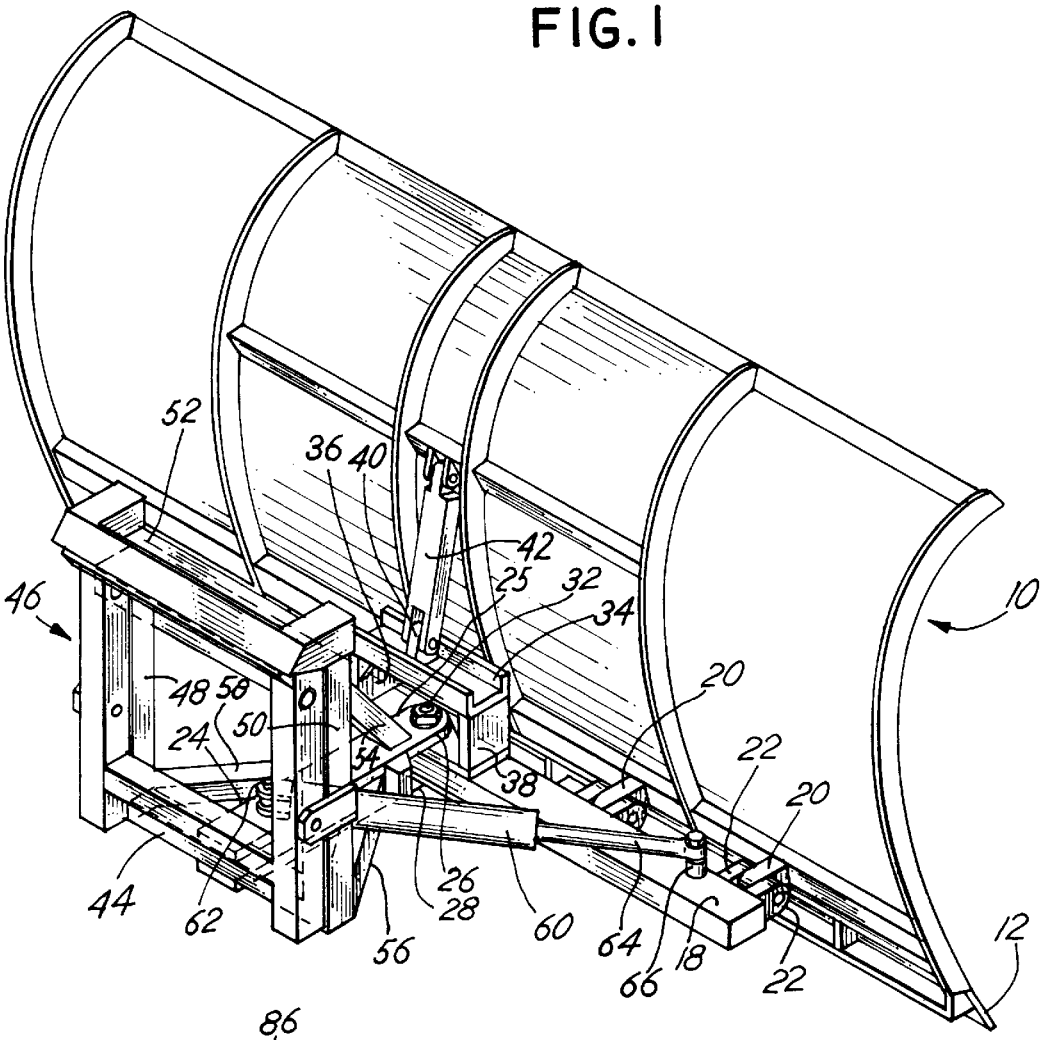
FIG. 1 is an isometric view of the improved mounting bracket of the invention as it is utilized for the support of a moldboard snow plow.
Figure 4:
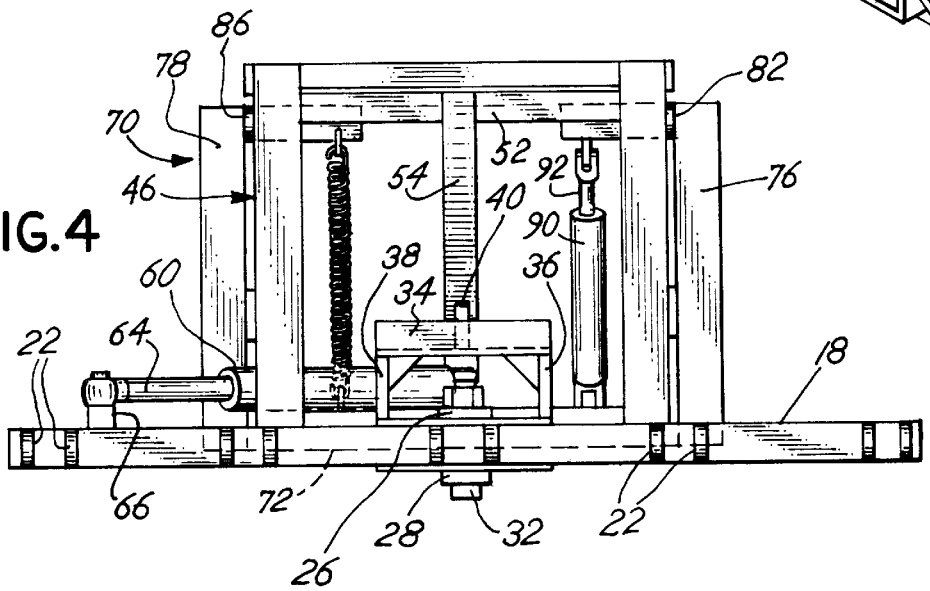
FIG. 4 is a front plan view of the plow construction of FIG. 2 wherein the moldboard plow has been removed so as to reveal the construction of the bracket assembly.
Figure 2:
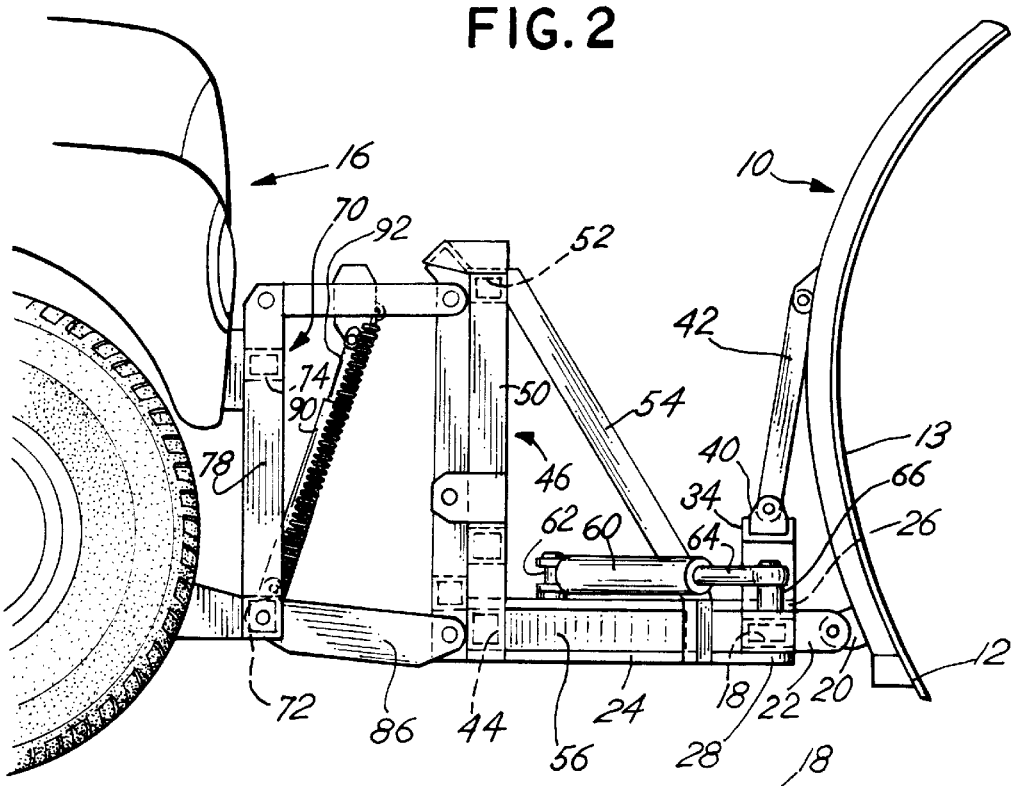
FIG. 2 is a side plan view of the plow construction of FIG. 1.
Figure 3:
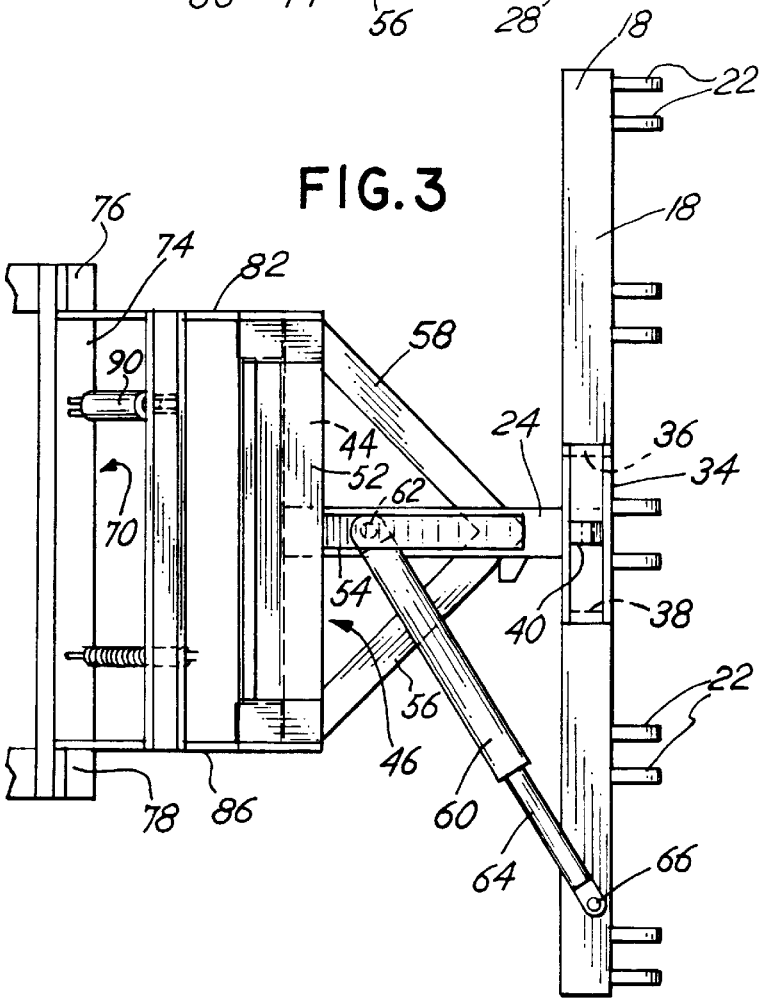
FIG. 3 is a top plan view of the plow construction of FIG. 2.

Referring to the FIGURES, in particular FIG. 1, there is depicted the mounting bracket of the invention in combination with a moldboard snow plow 10 and the vehicle 16. Thus a moldboard snow plow 10 is fabricated from sheet steel and includes a lower leading edge 12 and an arcuate plate or plow face 13. Typically, the plow 10 includes bracing on the back side thereof. The invention relates to the mechanism or assembly or mounting bracket for attaching the plow 10 to a vehicle 16.

The improved mounting bracket of the invention includes a forward cross beam or forward support cross member 18 which is comprised of a steel box beam having a vertical dimension of approximately 3 inches in the preferred embodiment and a horizontal cross section dimension of approximately 6 inches in the preferred embodiment. The beam 18 has a length which is sufficient to extend horizontally along the back side of the plow 10 so as to permit attachment of brackets 20 on the backside of the plow 10 to a series of forwardly projecting backside lugs or tabs 22 welded to the beam 18.

The mounting bracket further includes a horizontal support member 24 which may also be fashioned from a box beam. The forward end 25 of the support member 24 includes first and second spaced, horizontal parallel plates 26 and 28 which define a yoke for receipt of the box beam or cross member 18. The plates 26 and 28 thus include aligned openings which receive a vertical pivot pin 32.

The cross member 18 further includes a vertically spaced bracket member 34 which is positioned above and spaced from the pin 32 by means of parallel spaced box beam support arms 36 and 38. A rib or lug 40 is welded to the bracket member 34 and serves to connect a link 42 between the plow 10 and the bracket member 40. In this manner, the plow 10 is effectively attached to the cross member 18 with a three point hitch type connection involving the attachment plates 22 as well as the lug 40. This particular arrangement effects stabilization of the plow 10 relative to the cross member 18. Note also and very importantly that with this construction it is possible to move the plow 10 exceedingly close to the cross member 18. This results because the bracket member 34 is positioned directly over the pin 32. This particular construction therefor provides an efficiency or economy of design enabling placement of the plow 10 much closer to the vehicle 16 than with known prior art constructions.

The support member 24 is attached to a lower horizontal frame member 44 of a first frame 46. The first frame 46 includes not only the lower horizontal frame member 44 but spaced vertical frame members 48 and 50 as well as a spaced, top horizontal frame member 52. The frame 46 is connected to the support member 24 by means of braces including brace 54 and inside braces 56 and 60. All of the component parts are made from steel box beams which provides improved rigidity and strength. This construction also enables the assembly to be more compact thereby placing the plow 10 in closer proximity to the vehicle 16, the effect of which is to diminish the cantilever or tilting impact of the plow 10. Thus the plow 10, as well as the bracket member, are closer to the center of gravity of the vehicle 16 than with known prior art configurations.

The cross member 18 may be pivoted about the pin 32 by means of a hydraulic cylinder 60. One end of the cylinder 60 is pivotally attached to a pivot connection 62 on the support member 24. The opposite end of the cylinder 60, and more particularly rod 64 projecting from the cylinder 60, is attached to a pivot connection 66 on cross member 18. Operation of the cylinder 60 thus effects pivoting action of the plow 10. Preferably cylinder 60 is placed on what is known as the right hand side of the assembly. This arrangement is preferred since most plowing, at least in the United States, is effected on the right hand side of the road. Thus, the cylinder 60 may be operated to retract the rod 64. A stop 68 may be provided to limit the pivotal travel of the beam 18 and to prevent damage to the cylinder 60.

First frame 46 is positioned over a second frame 70. The second frame 70 includes a lower horizontal cross member 72 and a generally parallel upper cross member 74. Spaced vertical cross members 76 and 78 complete the frame 70. In a preferred embodiment of the construction, frames 46 and 70 or the first frame 46 and the second frame 70 are connected by linkage arms pivotally attached at the corners of the frames 46, 70. Thus linkage arms 80, 82, 84 and 86 effect the connection between the corners of the frame 46 and the frame 70. The vertical arms 48 and 50 are slightly longer between pivot points than the vertical arms 76 and 78. Thus, when a cylinder 90 operates a rod 92, wherein cylinder 90 and rod 92 connect between pivot points of the lower cross member 72 and upper cross member 52, the first frame 46 raises and effectively tilts the plow 10 upwardly a slight amount. The opposite effect results when the rod 92 is withdrawn within the cylinder 90. That is, the plow 10 will move downward and tilt slightly downwardly. This is a desired effect of the assembly inasmuch as the plow 10 may be tilted slightly upwardly when, for example, a plowing up a hill and may be tilted slightly downwardly when plowing down hill. In sum, the combination of the mounting bracket which includes the support member 24 and cross member 18 with the frames 46 and 70 provides a highly unique means of effecting control of the position of the plow 10 mounted on a vehicle 16. The frame 70 is attached to the vehicle by means well known to those in the art.

It is possible to vary the construction of the adjustable mounting bracket without departing from the spirit and scope of the invention. For example, the cylinder 90 may be reversed in position. The frame 46 and 70 may be triangular rather than rectangular. The length of the links 80, 82, 84 and 86 may be varied rather than the length of the vertical members 76 and 78. Thus, the invention is to be limited only by the following claims and their equivalents.

What is claimed is:

1. An adjustable mounting bracket for support of a moldboard snow plow having a curved blade, a lower edge, a concave forward side for directing plowed snow upward and then away from the moldboard as snow rises above the lower edge, a center and a backside with spaced attachment members projecting rearwardly therefrom for attachment to a mounting bracket, said mounting bracket comprising, in combination:

a forwardly projecting support member having a forward end with a vertical pivot axis, said support member including first and second forwardly projecting plates defining a connection yoke;

an elongate, horizontal, generally straight cross member with a midpoint and having a pivot connection substantially at the midpoint of said cross member, said cross member including an attachment member projecting forwardly therefrom and aligned for connection to one of the attachment members projecting rearwardly from the backside of the moldboard snow plow, said pivot connection of the cross member pivotally mounted between the plates of the yoke to the support member at the vertical pivot axis for rotation about said axis to effect positioning of a moldboard at a desired angle with respect to the direction of plowing movement of the plow;

a single cylinder actuator having one end connected to the support member rearwardly of the pivot axis, and the opposite end connected to the cross member at a position spaced from the vertical pivot axis;

a first frame oriented in a generally vertical plane for the support member, said first frame comprising a rectangular frame with spaced vertical sides and an upper and lower horizontal side with a midpoint, said support member attached to the midpoint of the lower horizontal side;

a second rectangular frame, and means for attaching the second frame to a plow vehicle, said first and second frames overlying each other and connected together by links pivotally connecting the corresponding corners of the frames for movement about horizontal pivot axes, the vertically spread pivot connections of the first frame having a spacing greater than the vertical spacing of the vertically spread pivot connections of the second frame whereby a moldboard plow attached to the link and cross member will tilt upwards as the first frame is moved vertically upward relative to the second frame and will tilt downwards as the first frame is moved vertically downward relative to the second frame.

2. The adjustable mounting bracket of claim 1 wherein the cross member is pivotal about the pivot connection generally in the range of ±35° from the direction of the plow travel.

3. The adjustable mounting bracket of claim 1 wherein the cross member is a box beam.

4. The adjustable mounting bracket of claim 1 further including a first vertical frame for the support member said first frame comprising a generally rectangular frame with spaced vertical and horizontal sides, said support member attached to the lower horizontal sides and the first frame by bracing members.

5. The adjustable mounting bracket of claim 4 including a second vertical frame and means for attaching the second vertical frame to a plow vehicle, said first and second frames overlying each other and connected together by links pivotally connecting the corresponding corners of the frames about horizontal pivot axes, the vertical sides of the first frame having a length greater than the vertical sides of the second frame whereby the moldboard plow will tilt upwards as the first frame is moved vertically upward relative to the second frame.

6. The mounting bracket of claim 1 wherein the cylinder extends from adjacent the center of the plow to the right hand side of the plow in the direction of plow travel.

7. The mounting bracket of claim 6 including a stop to limit pivotal movement of the plow.

* * * * *